US008197117B2

(12) United States Patent
White

(10) Patent No.: US 8,197,117 B2
(45) Date of Patent: Jun. 12, 2012

(54) METHOD FOR AGITATING POUCHED PRODUCTS

(75) Inventor: Peter J. White, Farmingdale, NY (US)

(73) Assignee: Tarpaulin.com, Inc., Woodbury, NY (US)

( * ) Notice: Subject to any disclaimer, the term of this patent is extended or adjusted under 35 U.S.C. 154(b) by 0 days.

(21) Appl. No.: 12/965,481

(22) Filed: Dec. 10, 2010

(65) Prior Publication Data

US 2011/0080800 A1 Apr. 7, 2011

Related U.S. Application Data

(62) Division of application No. 11/782,462, filed on Jul. 24, 2007.

(60) Provisional application No. 60/832,833, filed on Jul. 24, 2006.

(51) Int. Cl.
*B01F 11/00* (2006.01)

(52) U.S. Cl. ..... 366/197; 366/218; 366/348

(58) Field of Classification Search ..... 100/153; 141/77–79; 366/275, 279, 197–218, 348; 198/866

See application file for complete search history.

(56) References Cited

U.S. PATENT DOCUMENTS 1,570,235 A 1/1926 Fooks
1,596,606 A 8/1926 Fooks
2,336,438 A * 12/1943 Evans ..... 366/108
2,368,945 A 2/1945 Peebles
2,373,162 A * 4/1945 Brechtel ..... 198/523
2,380,134 A 7/1945 Waters
2,517,542 A 8/1950 Clifcorn et al.
2,569,656 A 10/1951 Chissom et al.
2,582,872 A * 1/1952 Krengel ..... 241/293
2,816,837 A 12/1957 Holsman
2,845,929 A * 8/1958 Strumia ..... 604/113
3,030,081 A * 4/1962 Wilson et al. ..... 366/348
3,052,559 A 9/1962 Peebles
3,283,523 A 11/1966 Long
3,302,423 A 2/1967 Morrison
3,464,835 A 9/1969 Castro
3,518,393 A * 6/1970 Bull et al. ..... 219/772
3,722,833 A * 3/1973 Inoue et al. ..... 366/348
3,732,917 A 5/1973 Deubel
3,819,158 A * 6/1974 Sharpe et al. ..... 366/349
3,833,203 A * 9/1974 Garlinghouse ..... 366/113
3,968,818 A * 7/1976 Gerrans ..... 141/78
4,198,166 A * 4/1980 Tuns ..... 366/112
4,384,463 A 5/1983 Rica et al.
4,385,035 A 5/1983 Akitoshi et al.
4,437,315 A 3/1984 Rica et al.
4,505,670 A 3/1985 Silvestrini et al.
4,550,653 A * 11/1985 Hedenberg ..... 99/348
4,550,654 A * 11/1985 Hedenberg ..... 99/348
4,590,850 A * 5/1986 Hedenberg ..... 99/348

(Continued)

FOREIGN PATENT DOCUMENTS

SU 1681937 A1 * 10/1991

*Primary Examiner* — Charles E Cooley
(74) *Attorney, Agent, or Firm* — Hoffmann & Baron, LLP

(57) ABSTRACT

A system and method for agitating pouched products traveling along a conveyor belt to facilitate heat transfer, blending, mixing and/or stirring of the contents thereof. An agitation station is located along the conveyor belt, and includes an agitator secured to one end of an arm, the arm being pivotally secured to the frame supporting the conveyor belt.

7 Claims, 6 Drawing Sheets

U.S. PATENT DOCUMENTS 4,784,297 A * 11/1988 Katz ..... 222/161
4,795,265 A * 1/1989 Dahlberg et al. ..... 366/69
4,803,086 A * 2/1989 Hedenberg ..... 426/87
4,907,723 A * 3/1990 Katz ..... 222/105
5,009,150 A 4/1991 Andersen
5,146,840 A * 9/1992 Hedenberg ..... 99/328
5,370,174 A 12/1994 Silvestrini et al.
5,699,902 A * 12/1997 Sperry et al. ..... 206/219
5,727,370 A 3/1998 Sperry
5,810,259 A 9/1998 Sinclair
5,873,221 A * 2/1999 Sperry et al. ..... 53/472
5,913,603 A * 6/1999 Sperry et al. ..... 366/204
6,142,396 A 11/2000 Gallus
6,142,661 A * 11/2000 Lafond ..... 366/204
6,206,632 B1 3/2001 Gallus
6,267,498 B1 * 7/2001 Lafond et al. ..... 366/204
6,272,813 B1 * 8/2001 Sperry et al. ..... 53/440
6,273,600 B1 * 8/2001 Sharpe ..... 366/117
6,301,905 B1 10/2001 Gallus
6,340,449 B1 1/2002 Gallus
6,369,394 B1 * 4/2002 Lee ..... 250/455.11
6,387,322 B1 5/2002 Gallus
6,416,212 B1 * 7/2002 Rogers et al. ..... 366/117
6,439,759 B1 * 8/2002 Ray et al. ..... 366/197
6,629,599 B2 * 10/2003 Sperry et al. ..... 206/219
6,634,783 B2 * 10/2003 Baron ..... 366/204
7,077,559 B2 * 7/2006 Hlavinka et al. ..... 366/197
7,175,334 B2 * 2/2007 Babson et al. ..... 366/109
7,377,686 B2 * 5/2008 Hubbard ..... 366/208
7,614,781 B2 * 11/2009 Esveld et al. ..... 366/275
7,789,551 B2 * 9/2010 Ray et al. ..... 366/108
7,891,860 B2 * 2/2011 Hubbard ..... 366/208
7,963,690 B2 * 6/2011 Thompson et al. ..... 366/275
8,042,991 B2 * 10/2011 Thompson et al. ..... 366/275
8,047,704 B2 * 11/2011 Thompson et al. ..... 366/275
2003/0031085 A1 * 2/2003 Baron ..... 366/144
2005/0219944 A1 * 10/2005 Babson et al. ..... 366/109
2007/0097783 A1 * 5/2007 Babson et al. ..... 366/109
2011/0080800 A1 * 4/2011 White ..... 366/207

* cited by examiner

METHOD FOR AGITATING POUCHED PRODUCTS

This application is a divisional of U.S. application Ser. No. 11/782,462 filed Jul. 24, 2007, which in turn claims the benefit of U.S. Provisional Application Ser. No. 60/832,833 filed on Jul. 24, 2006.

BACKGROUND OF THE INVENTION

The present invention relates to the agitation of pouched products and, more particularly, to a system and method for agitating pouched products traveling along a conveyor belt to facilitate heat transfer, blending, mixing and/or stirring of the contents thereof.

Those skilled in the art will appreciate that various products are packaged in flexible resilient containers, e.g., pouches made of plastic film or other such flexible materials. These products may include food products such as sauces, soups, juices, gravies, etc. or industrial/medical products including gels and salves. The mentioned pouches, which can take many different shapes, are often times transported along a conveyor belt during the packaging/processing stage. The pouched products may need to be heated as they travel along the conveyor belt (e.g., to effect a pasteurization process), may need to be cooled (e.g., to retard growth of bacteria) or may need to be mixed/stirred for miscellaneous processing purposes.

For example, in a typical food preparation process, a pouch is hot-filled with a food product and thereafter sealed. Once sealed, the pouched product is subjected to a pasteurization process where it is heated to a predetermined temperature for a preselected period of time. The pouched product is then rapidly cooled. This cooling is typically accomplished as the pouch moves along a conveyor belt, e.g., by spraying cold water and/or air onto the pouch. However, because the pouch contains a quantity of heated product, and because the cold water/air contacts only the outer surface of the pouch, it has been difficult in the past to quickly and uniformly cool the entire contents of the pouch. Failure to quickly and uniformly cool the entire contents of the package can result in overprocessing and/or deterioration of the quality of the product contained in the pouch.

Available systems attempt to increase the heat transfer rate of the pouched products by "flipping" the pouch from one side to the other as it proceeds down the conveyor belt in an effort to mix the contents of the pouch. This may be accomplished by various mechanical equipment, e.g., a U-shaped slide extending between one section of the conveyor belt and a second section of the conveyor belt. It will be appreciated, however, that "flipping" of the pouches to increase the heat transfer rate has several significant disadvantages, including the potential of breaking or creating leaks in the pouch, wrinkling the pouch and/or marring the printing contained on the pouch. Moreover, the currently available systems have the potential to cause a significant backup in the line in the event that a pouch becomes jammed while being "flipped."

Other prior art systems use basket-like transport to move the packages through a fluid bath or spray while subjecting the package to a rocking motion. However, such systems are complex and difficult to operate. In addition, they do not allow for the ready modification of existing conveyor belts. Still, other known systems immerse the pouched product in a fluid bath while subjecting the pouches to forces such as a wet jet or a vibrating member. Again, these systems are complex, difficult to operate and not suitable for the retrofitting of existing conveyor belts.

There is therefore a need in the art for a system and method which can facilitate heat transfer, blending, mixing and/or stirring of the product contained within a flexible resilient pouch traveling along a conveyor belt. There is a further need in the art for a simple, energy efficient system which allows for the ready modification of existing conveyor belts.

SUMMARY OF THE INVENTION

The present invention, which addresses the needs of the prior art, relates to a system for agitating a pouched product. The system includes a frame. The system further includes a conveyor belt supported by the frame for transporting the pouched product, the conveyor belt defining a pouch pathway. The system additionally includes at least one agitation station located along the conveyor belt for agitating the pouched product traveling therepast. The station includes an agitator and an arm having first and second ends. The first end of the arm is pivotally secured to the frame. The agitator is secured to the second end of the arm. The arm is located to position the agitator adjacent the belt and within the pathway of the pouch whereby movement of the pouch through the agitation station causes the pouch to engage the agitator.

The present invention further relates to a method for agitating pouched products. The method includes the step of providing a frame. The method includes the further step of providing a conveyor belt supported by the frame for transporting the pouched product, the conveyor belt defining a pouch pathway. The method includes the additional step of providing at least one agitation station located along the conveyor belt, the station including an agitator and an arm having first and second ends, the first end of the arm being pivotally secured to the frame, the agitator being secured to the second end of the arm, the arm being located to position the agitator adjacent the belt and within the pathway of the pouch. Finally, the method includes the step of transporting the pouched product along the conveyor belt such that the pouched product travels through the agitation station causing the pouch to engage the agitator whereby the product within the pouch is agitated.

Finally, the present invention relates to a method of retrofitting an existing conveyor belt apparatus to agitate pouches traveling therealong. The apparatus including a conveyor belt supported by a frame, the conveyor belt defining a pouch pathway. The method includes the step of locating an agitation station at a preselected position along the conveyor belt, the station including an agitator and an arm having first and second ends, the first end of the arm being pivotally secured to the frame, the agitator being secured to the second end of the arm, the arm being located to position the agitator adjacent the belt within the pathway of the pouch. The method includes the further step of pivotally securing the first end of the arm to the frame such that the agitator is located at a position adjacent the belt and within the pathway of the pouch.

As a result, the present invention provides both a system and method which can facilitate heat transfer, blending, mixing and/or stirring of the product contained within a flexible resilient pouch traveling along a conveyor belt during a manufacturing/processing procedure. In addition, the present invention provides a simple, energy efficient system which allows for the ready modification of existing conveyor belts without the need to disassemble such existing systems.

DETAILED DESCRIPTION OF THE INVENTION

As discussed further hereinbelow, the present invention relates to a system for agitating pouched products traveling along a conveyor belt to facilitate heat transfer, blending, mixing and/or stirring of the contents thereof. This is accomplished in a system that employs a limited number of parts, is simple to operate and maintain, does not require additional sources of energy and may be easily added to existing conveyor belt systems.

Figure 1:
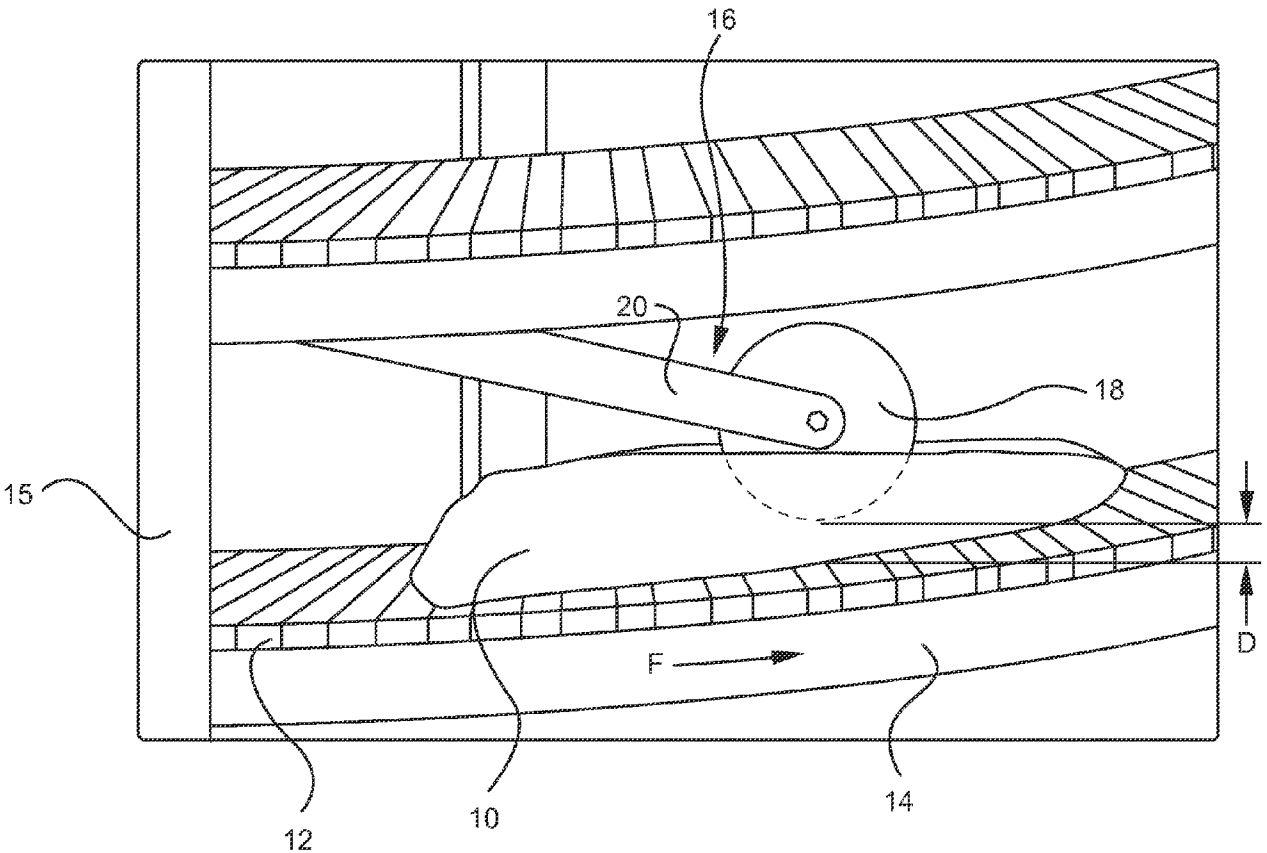
FIG. 1 is a perspective view showing a pouched product in contact with an agitator of the present invention.
Figure 2:
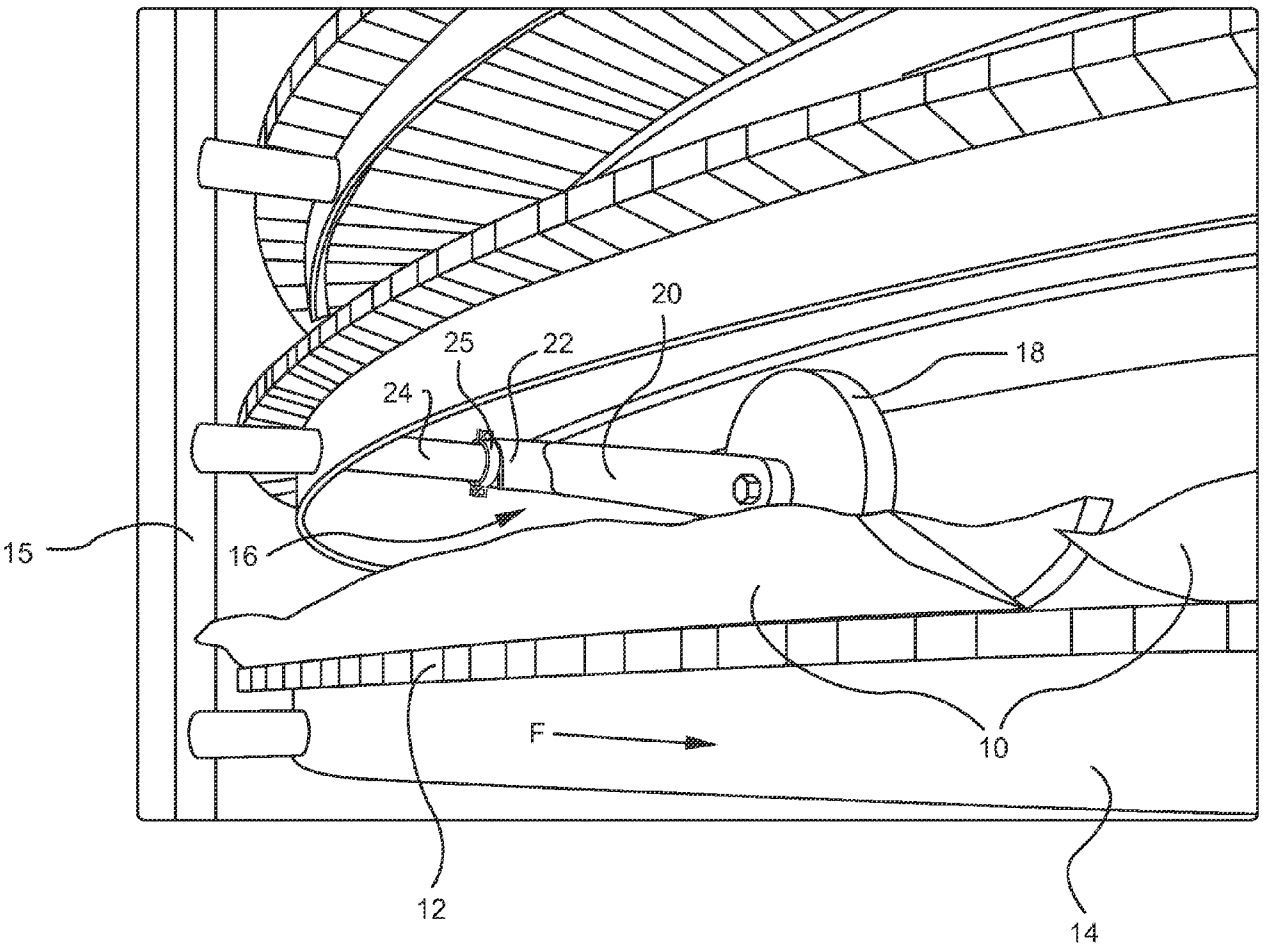
FIG. 2 is another perspective view showing the pouched product in contact with the agitator of FIG. 1.
Figure 3:
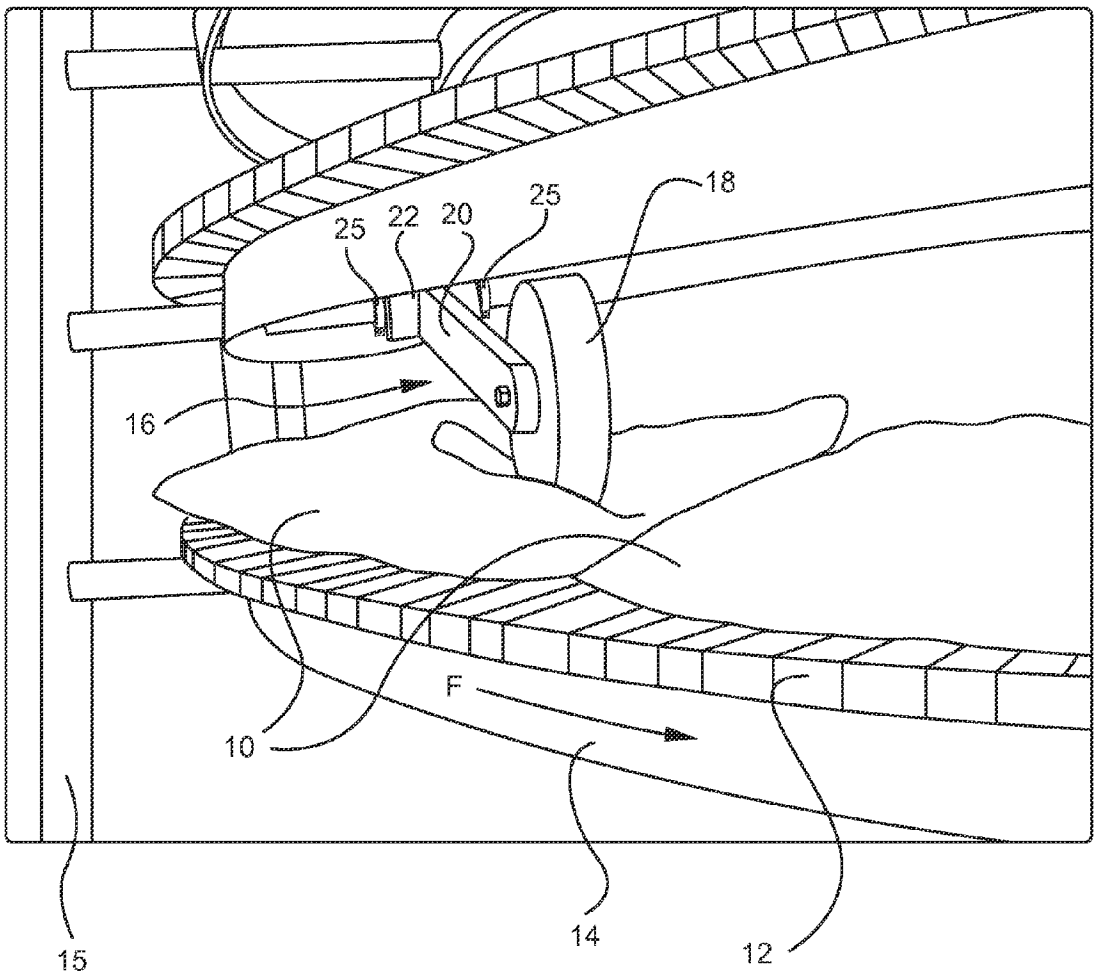
FIG. 3 is still another perspective view showing the pouched product in contact with the agitator of FIG. 1.

Referring to FIGS. 1-3, a pouch 10, containing a food product or another such liquid/viscous product, is transported along a conveyor belt 12 in the direction of arrow F. Conveyor belt 12 rides upon a pair of opposing tracks 14 supported by a frame 15. In the embodiment of FIGS. 1-3, belt 12 follows a generally circular path. In other embodiments, the belt may follow a generally straight path, or another selected direction.

Figure 4:
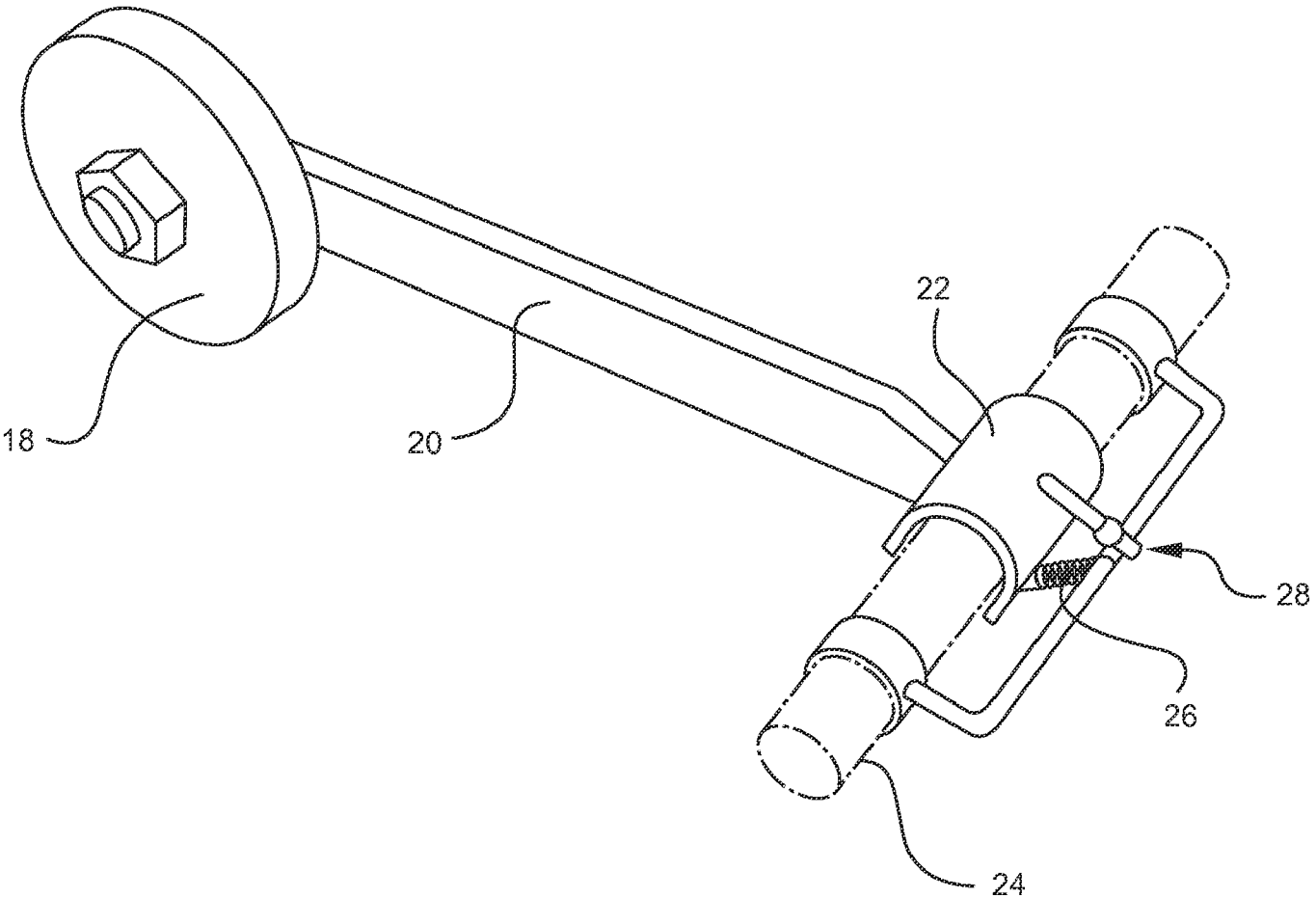
FIG. 4 is a detail of the arm which supports the agitator of the present invention.

The system of the present invention includes a plurality of agitation stations 16 positioned at pre-selected locations along the path of the conveyor belt. Each station preferably includes at least one agitator, e.g., a wheel 18 rotatably supported by an arm 20. In turn, arm 20 is pivotally coupled to the frame by, for example, a C-shaped coupler 22 (best shown in FIG. 4).

In one preferred embodiment, coupler 22 is coupled to a rod 24 extending transverse to and supporting tracks 14 (see FIG. 2). In turn, rod 24 is supported by the posts of frame 15. Hardware 25 may be used to locate coupler 22 at a particular position along rod 24. Of course, it is contemplated herein that arm 20 can be pivotally connected to any suitable portion of frame 15. It is also contemplated that coupler 22 can take various forms including a design wherein the coupler has a width approximately equal to the distance between tracks 14. Coupler 22 may include an interior bearing surface to facilitate pivoting about rod 24, or may be sized to receive a separately-formed bearing. Finally, it is contemplated herein that coupler 22 may be fixedly secured to rod 24, and that a pivoting joint be provided between the end of the arm and the coupler.

Those skilled in the art will appreciate that conveyor belt frames commonly employ such horizontally-extending rods to support the tracks on which the belt travels. It has been discovered herein that these rods (which are generally accessible even in existing systems) can be used to mount the mentioned arm/agitator, thereby allowing existing systems to be readily modified. More to the point, the design of coupler 22 allows the arm to be pivotally coupled to the existing rod without the need to disassemble the existing apparatus.

In operation, pouch 10 travel along conveyor belt 12 and may be subjected to heat and/or cold water spray, cold air or other cooling techniques. As it approaches agitation station 16, the leading end of the pouch contacts wheel 18. The movement of the conveyor belt forces pouch 10 under wheel 18, thus causing arm 20 to pivot about rod 24 whereby wheel 18 is moved away from the surface of conveyor belt 12. As pouch 10 continues to move along conveyor belt 12, wheel 18 rolls along the length of pouch 10. In one preferred embodiment, as shown in FIGS. 1-3, the wheel is positioned to roll along the approximate center of pouch 10.

Those skilled in the art will appreciate that wheel 18 will agitate the product contained within the pouch, thereby mixing the product in the center of the pouch (which remains at a higher temperature) with the product near the surfaces of the pouch (which has been cooled) or vice versa depending on whether the product contained in the pouch is being heated or cooled. This mixing is accomplished without the need to "flip" or otherwise subject the pouch to unnecessary stress which can puncture and/or otherwise weaken the bag, which may wrinkle the bag and/or which may mar the printing on the bag. This mixing may also be desired in other applications which do not necessarily involve heat transfer.

Wheel 18 may be weighted to apply a sufficient downward force or, alternatively, agitation station 16 may include a biasing means (e.g., a spring 26) which urges wheel 18 toward the upper surface of conveyor belt 12. Because arm 20 is pivotably mounted on rod 24, wheel 18 is allowed to travel a distance D in a direction away from and perpendicular to the surface of the conveyor belt. This distance can be pre-selected based upon the size and configuration of pouch 10. More particularly, station 16 may include an adjusting mechanism 28 which allows the operator to select the degree to which arm 20 can pivot about rod 24. Adjusting mechanism 28 may also include means for adjusting the bias of the spring (if any) applied to arm 20 whereby the force required to move wheel 18 away from the surface of conveyor belt 12 can be increased or decreased as desired.

It is contemplated herein that each agitation station will include at least one agitator for contacting the pouch and agitating the product contained therein. This agitator may include a single wheel, as shown in FIGS. 1-3, multiple wheels positioned side-by-side (for wider conveyor belts), or other geometrically-shaped objects.

Figure 5:
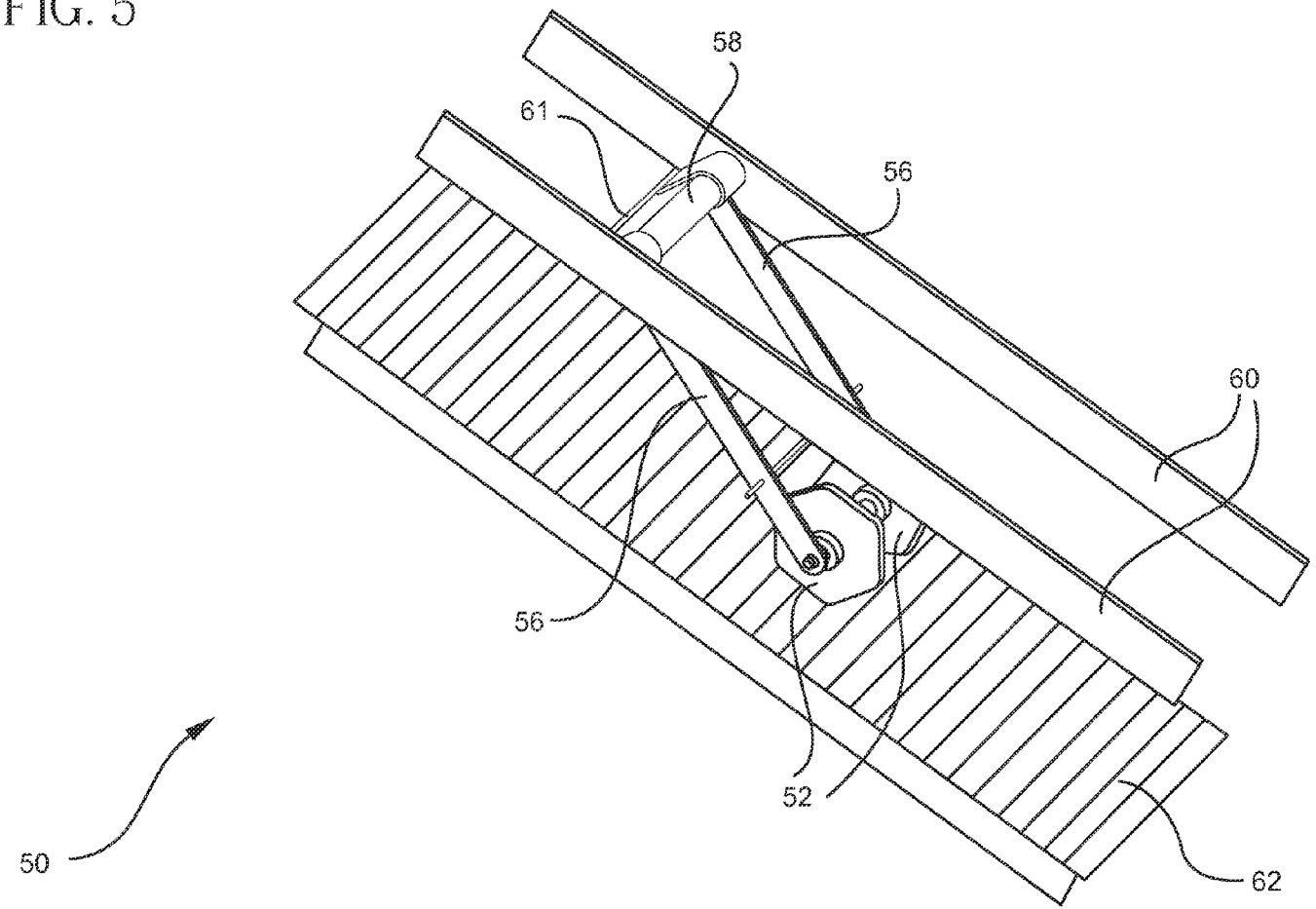
FIG. 5 is a perspective view of an alternative embodiment of the present invention.
Figure 6:
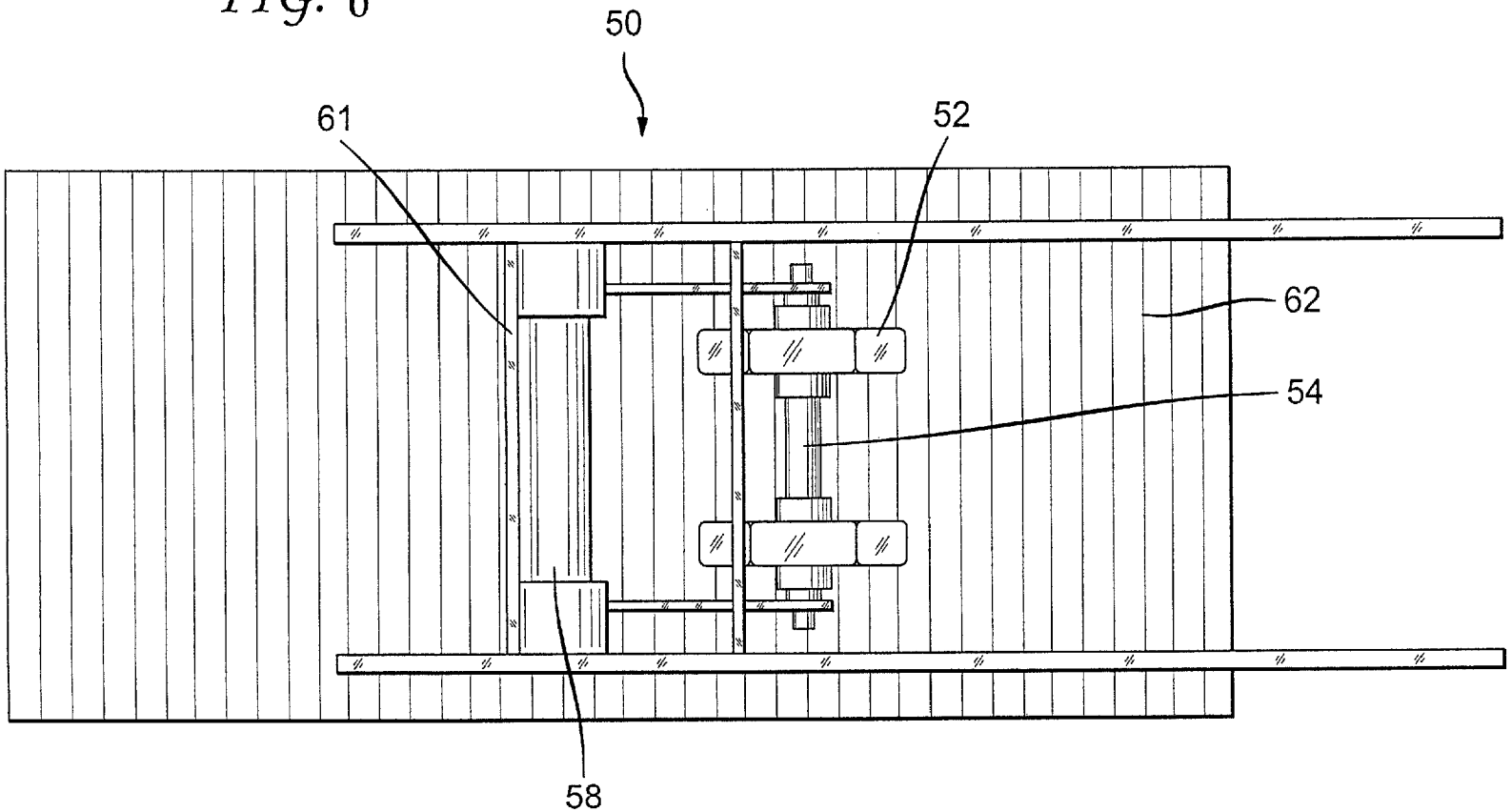
FIG. 6 is another perspective view of the alternative embodiment of FIG. 5.

For example, an alternative agitation station 50 is shown in FIGS. 5-6. In this embodiment, agitation station 50 includes a pair of agitators 52 rotatably supported on a shaft 54. Agitators 52 may be formed in the shape of a hexagon, which may increase the agitation of the product contained in the pouch because of the irregular geometry of the members. In the configuration shown in FIGS. 5-6, station 50 includes a pair of arms 56, both of which are pivotally supported by a rod 58, which extends through and supports tracks 60. An adjusting mechanism 61 allows the operator to control the degree to which arms 56 can pivot about rod 58 and/or to adjust the biasing (if any) of agitator 52 towards conveyor belt 62.

In operation, a pouch traveling along conveyor belt 62 will simultaneously contact agitators 52, both of which will roll along the length of the bag as the bag travels therepast. The use of multiple agitation members may be needed to increase the agitation of the product in the pouch, depending on such factors as the temperature of the product, the time available for heat transfer and/or the width of the pouch.

Although each of the embodiments described hereinabove utilizes an agitator which can "roll" along the length of the pouch, it is contemplated herein that the agitator may consist of a non-rolling device pivotably attached to the arm. Although such a device will not rotate as the pouch travels thereunder, the downwardly directed force that such member applies against the pouch will agitate the product contained therein. Moreover, the device may be configured such that it vibrates and/or shakes as the pouch travels thereunder, enhancing the ability of such device to agitate the product contained in the pouch.

It is also contemplated herein that the agitation system of the present invention may include agitators which contact the underside of a pouch. For example, a plurality of agitation wheels could be located between adjacent conveyor belts on particular systems. It is also contemplated that the agitators may be supported along the sides of the conveyor belt such that they pivot inwards/outwards to contact the sides of the pouch. It is further contemplated that the agitators may be supported directly above the point of contact with the pouch wherein the arm supporting the agitator may include telescoping portions which allow the wheel to travel in a direction perpendicular to the conveyor belt. Finally, it will be recognized by those skilled in the art that because the agitation system of the present invention facilitates the heat transfer process between the contents of the pouch and the exterior environment, the present system requires less energy and is therefore more energy efficient than known prior art systems.

It will be appreciated that the present invention has been described herein with reference to certain preferred or exemplary embodiments. The preferred or exemplary embodiments described herein may be modified, changed, added to or deviated from without departing from the intent, spirit and scope of the present invention and it is intended that all such additions, modifications, amendments and/or deviations be included in the scope of the following claims.

The invention claimed is:

1. A method for agitating pouched products, comprising:

a) providing a frame;

b) providing a conveyor belt supported by said frame for transporting said pouched product, said conveyor belt defining a pouch pathway and including one cylindrical rod positioned above and extending transverse to said pouch pathway; and c) providing at least one agitation station located along said conveyor belt, said station including an agitator and an arm having first and second ends, said first end of said arm including a C-shaped coupler for removable engagement with said rod whereby said first end is pivotally secured to said frame, said agitator including a wheel rotatably secured to said second end of said arm, said arm being located to position said wheel adjacent said belt and within said pouch pathway;

d) transporting said pouched product along said conveyor belt such that said pouched product travels through said agitation station causing said pouch to engage said wheel thereby causing said arm to pivot about said first end, whereby the product within said pouch is agitated.

2. The method according to claim 1, wherein said transporting step causes said pouch to travel under said agitator thereby causing said arm to pivot with respect to said frame and allowing said wheel to roll along the length of said pouch.

3. The method according to claim 2, further comprising the step of biasing said agitator in a direction extending towards said belt.

4. The method according to claim 3, further comprising the step of adjusting the degree of pivoting of said arm with respect to said frame.

5. A method of retrofitting an existing conveyor belt apparatus to agitate pouches traveling therealong, said apparatus including a conveyor belt supported by a frame, said conveyor belt defining a pouch pathway and said frame including at least one cylindrical rod positioned above and extending transverse to said pouch pathway, the method comprising the steps of:

a) locating an agitation station at a preselected position along said conveyor belt, said station including an agitator and an arm having first and second ends, said first end of said arm including a C-shaped coupler for removable engagement with said rod, said agitator including a wheel rotatably secured to said second end of said arm, said arm being located to position said wheel adjacent said belt and within said pouch pathway;

b) pivotally securing said C-shaped coupler at said first end of said arm to said cylindrical rod of said frame such that said agitator wheel is located at a position adjacent said belt and within said pouch pathway thereby causing said arm to pivot about said first end when said wheel engages a pouch within said pouch pathway.

6. The method according to claim 5, wherein said frame includes at least one set of tracks and a plurality of rods which extend transverse to said tracks for support thereof, said conveyor belt being supported upon said tracks and defining an upper transporting surface, and wherein said first end of said arm is pivotally secured to one of said rods positioned above said upper transporting surface.

7. The method according to claim 6, wherein said C-shaped coupler is secured to one of said rods without disassembling said rods from said frame.

* * * * *